US006843197B1

(12) United States Patent
Nixon et al.

(10) Patent No.: US 6,843,197 B1
(45) Date of Patent: Jan. 18, 2005

(54) NEAR SHORE PORT SECURITY BARRIER

(75) Inventors: Laurence G. Nixon, Port Hueneme, CA (US); Stephen Slaughter, Costa Mesa, CA (US); Robert J. Taylor, Camarillo, CA (US); William Seelig, Rockville, MD (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 26 days.

(21) Appl. No.: 10/622,177

(22) Filed: Jul. 17, 2003

(51) Int. Cl.[7] ..... B63G 9/04
(52) U.S. Cl. ..... 114/241; 114/240 C; 114/240 E
(58) Field of Search ..... 114/10, 14, 240 A–240 E, 114/240 R, 241; 405/211

(56) References Cited

U.S. PATENT DOCUMENTS 1,151,607 A * 8/1915 Newhall et al. ..... 114/241
1,295,818 A * 2/1919 Trask ..... 114/240 B
1,299,243 A * 4/1919 Sheransky ..... 114/240 B
1,309,391 A * 7/1919 Adkins ..... 102/409
1,326,156 A * 12/1919 Elia ..... 114/240 E
2,395,944 A * 3/1946 Smith ..... 114/240 R
6,681,709 B1 * 1/2004 Nixon et al. ..... 114/241

* cited by examiner

*Primary Examiner*—Sunil Singh
(74) *Attorney, Agent, or Firm*—David S. Kalmbaugh

(57) ABSTRACT

A near shore port security barrier for protecting a vessel docked at a port facility from an incoming waterborne craft which is being used to inflict damage on the vessel. The near shore port security barrier consist of a plurality of floating barrier modules connected to one another and placed adjacent the hull of the vessel the near shore port security barrier is designed to protect. A wire mesh barrier fence, which is positioned on the outer perimeter of each floating barrier module is also provided to protect the vessel.

20 Claims, 12 Drawing Sheets

NEAR SHORE PORT SECURITY BARRIER

BACKGROUND OF THE INVENTION

1. Field of the Invention

The present invention relates generally to a security system which protects vessels docked in a port from being damage by explosive laden watercraft. More particularly, the present invention relates to an near shore port security barrier which utilizes a fixed fence structure attached to a floating barrier pontoon to protect ships docked at a port.

2. Description of the Prior Art

Ocean going vessels docked at a port, whether commercial or military, are vulnerable to by asymmetric threats, such as small watercraft laden with explosive or munitions. These threat watercraft can be pleasure boats or other commercially available watercraft which are difficult if not impossible to distinguish from other non-threatening watercraft. Because of the structure and layout of port facilities, it is not very difficult for a small hostile watercraft to pull alongside a moored vessel and then detonate explosives causing severe damage with little or no warning to personnel on board the vessel.

In the past, port security barriers have been designed and deployed to protect the port facilities and not individual vessels by, for example positioning the barrier at the entrance to the port facility. Some the port security barriers are inexpensive, low freeboard, line of demarcation barriers that function to clearly mark restricted area within the port. Other more expensive security barriers provide a physical security barrier for the port facility but not for individual vessels within the facility in the event the barrier is penetrated.

Accordingly, there is a need for a portable port security barrier which may be used within a port facility to protect vessels from attack by hostile explosive laden watercraft.

SUMMARY OF THE INVENTION

The present invention overcomes some of the disadvantages of the port security barriers utilized in the past in that it comprises a relatively simple design, and highly effective port security barrier which is adapted for use with a vessel to prevent damage to the vessel caused by an attack from an explosive laden watercraft. Since the near shore port security barrier is designed to be easily moved from one vessel to another vessel, the near shore port security barrier provides a substantial deterrence to an attack while the vessel is docked at a port facility.

The near shore port security barrier comprises a wire mesh barrier fence supported by floating barrier modules, which are connected to one another. Each barrier module is approximately fifty feet in length and is designed to be connected in series to another module to provide for a continuous barrier of varying length depending upon the size of the vessel the barrier is protecting. The near shore port security barrier includes fixed fences and flexible fences on each floating barrier module which overlap with an adjoining module to ensure that the near shore port security barrier is continuous along its whole length and the length of the vessel.

The flexible fences which are hinged use torsion bar spring assemblies that accommodate relative motion of the modules while keeping the fence material flush with the fence on an adjacent barrier module. The two floating barrier modules located at each end of the vessel have optional side fences that close the end of the near shore port security barrier against the vessel.

Each floating barrier module has a pair of fenders designed to engage the hull of the vessel against which the barrier is deployed.

When an attack from a hostile craft occurs and the attacker attempts to disconnect the barrier modules, the near shore port security barrier provides sufficient delay time for security forces to respond to the threat.

When an attacking watercraft attempts to force its way through the near shore port security barrier, the near shore port security barrier is designed to transfer the imposed loads through the near shore port security barrier structure and fendering to the ship or vessel or the mooring system for the near shore port security barrier.

When the attacking craft is filed with explosives the near shore port security barrier provides a minimum standoff distance to prevent catastrophic damage to critical ship systems. The combination of barrier material and standoff distance attenuates the effects of munitions and explosives when these explosive are used to attack a ship. The near shore port security barrier is modular so that the barrier material and standoff distance can be adjusted to meet specific existing or evolving threats.

DETAILED DESCRIPTION OF THE PREFERRED EMBODIMENT

Figure 1:
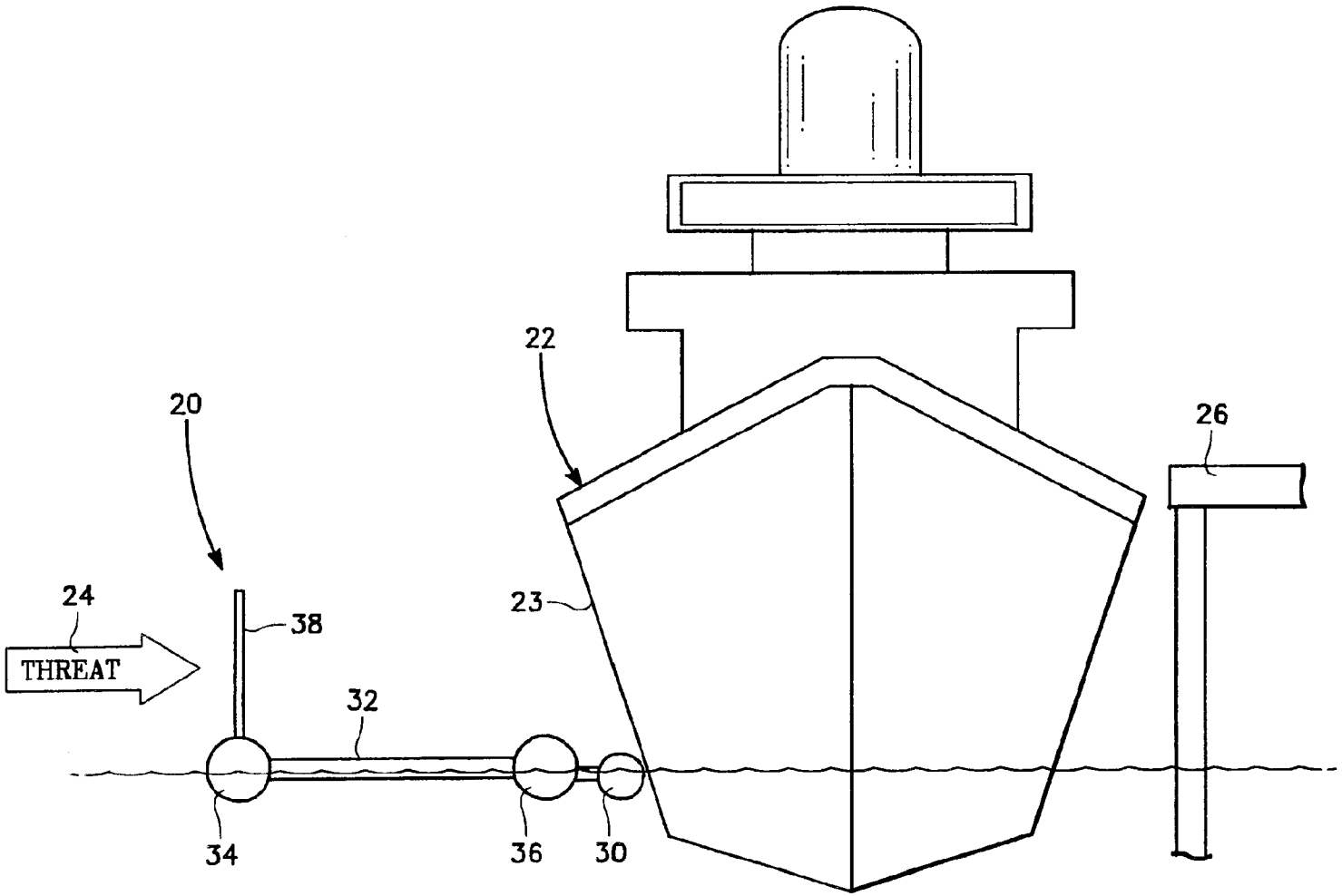
FIG. 1 is a plan view illustrating the modular structure of the near shore port security barrier being used to protect a vessel docked at a port facility from attack by a hostile watercraft.

Referring to FIGS. 1–4, the in near shore port security barrier 20 comprises a barrier which protects an ocean going vessel 22 from attack by a threat watercraft 24 while docked at a pier 26 at harbor facility or at a set distance from the pier 26 depending upon on a perceived threat (for example threat watercraft 24) and port characteristics. The threat watercraft 24 may be a pleasure boat or other small high speed vessel, which is laden with explosives or munitions that are detonated when the watercraft 24 is in proximity to vessel 22. When the explosive materials aboard watercraft 24 are triggered severe damage to vessel 22 generally occurs.

Figure 3:
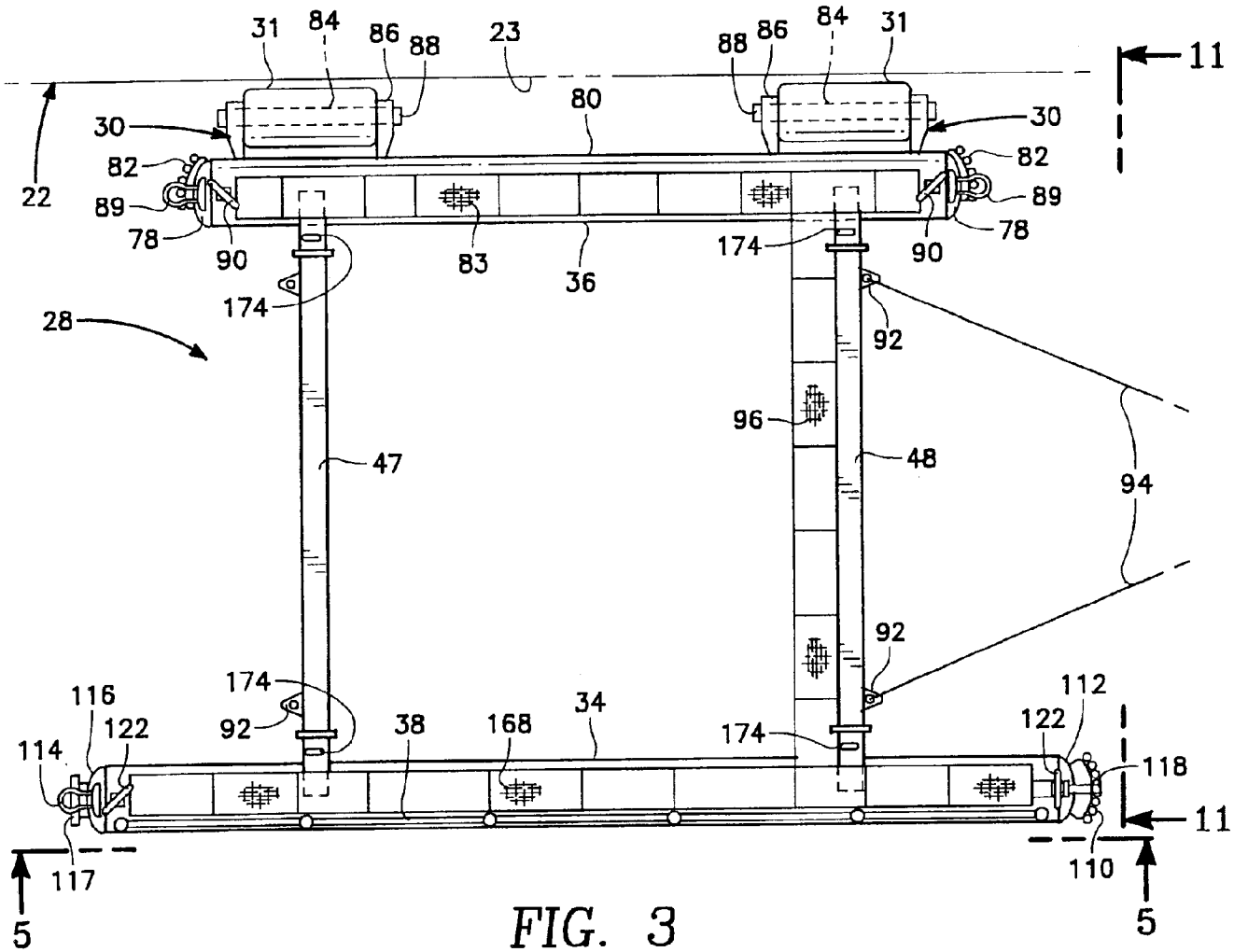
FIG. 3 is a detailed top view of a barrier module for the near shore port security barrier.
Figure 4:
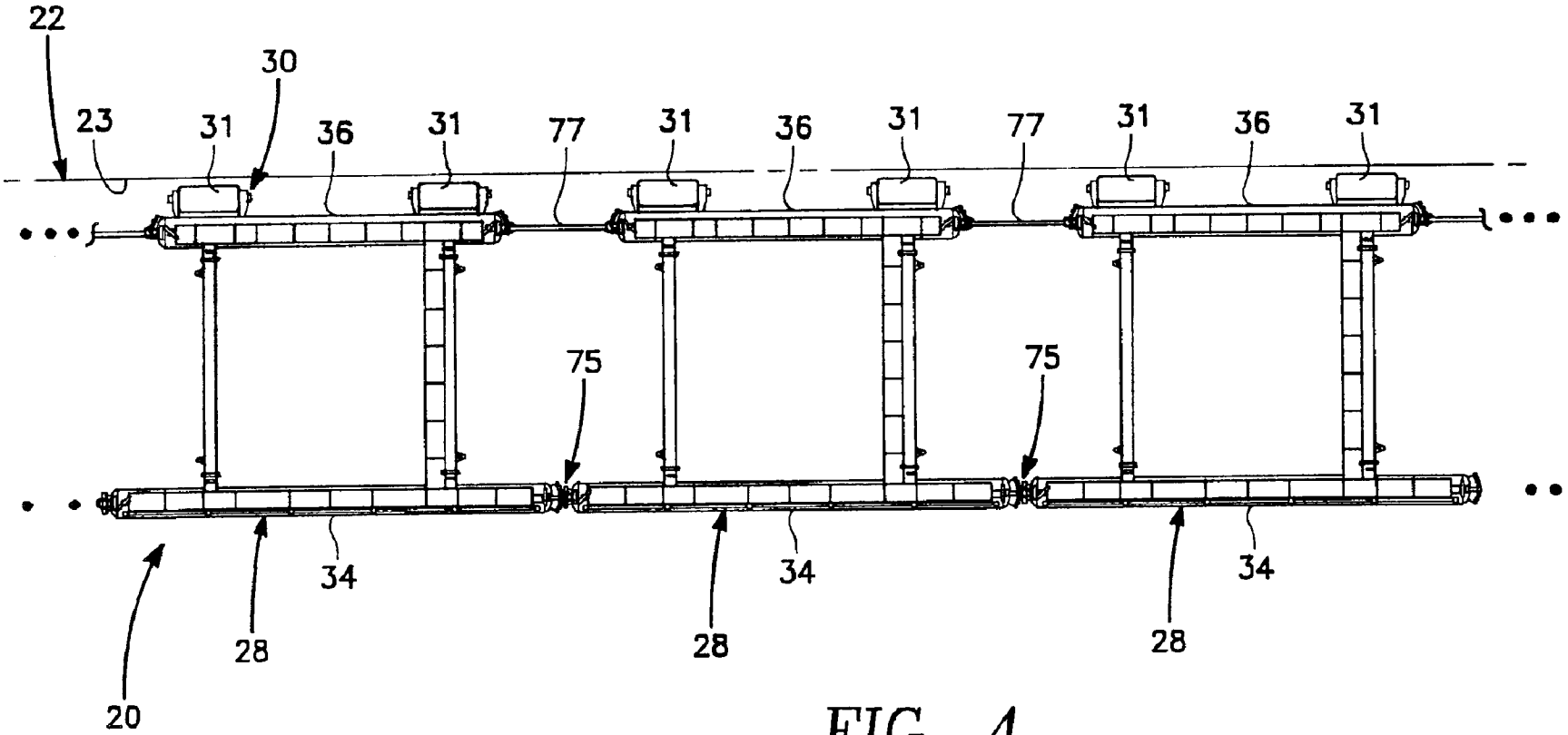
FIG. 4 is a top view illustrating three barrier modules for the near shore port security barrier positioned adjacent one another.

The near shore port security barrier 20 comprises a plurality of barrier modules 28 (FIG. 3) which are fitted together in the manner illustrated in FIG. 4. Each module includes fendering system 30, which protects vessel 22 and near shore port security barrier 20 during normal port operations and also function to dissipate energy of, any threat watercraft 24 attacking the barrier 20. As shown in FIG. 1, the fender 31 rest against the hull 23 of ocean going vessel 22.

When the near shore port security barrier 20 is moored then the mooring combined with the added mass of a barrier floatation system/structure 32 which includes pontoons 34 and 36 function to absorb energy from the threat watercraft 24. The location of a barrier fence/screen fence 38 on each barrier module 28 provides a relatively safe standoff distance from the protected vessel 22 that prevents attacking threat craft 24 from getting close enough to vessel 22 to cause catastrophic damage by detonating explosives or other munitions. The standoff distance can be varied to meet requirements for certain threat thresholds. The barrier material that serves to dissipate or attenuate the effects of an explosion can also be varied in accordance threat thresholds.

The near shore port security barrier 20 and its modules 28 are designed for deployment and recovery by port work boats such as tugs to minimize the impact on daily port operations and productivity.

Figure 2:
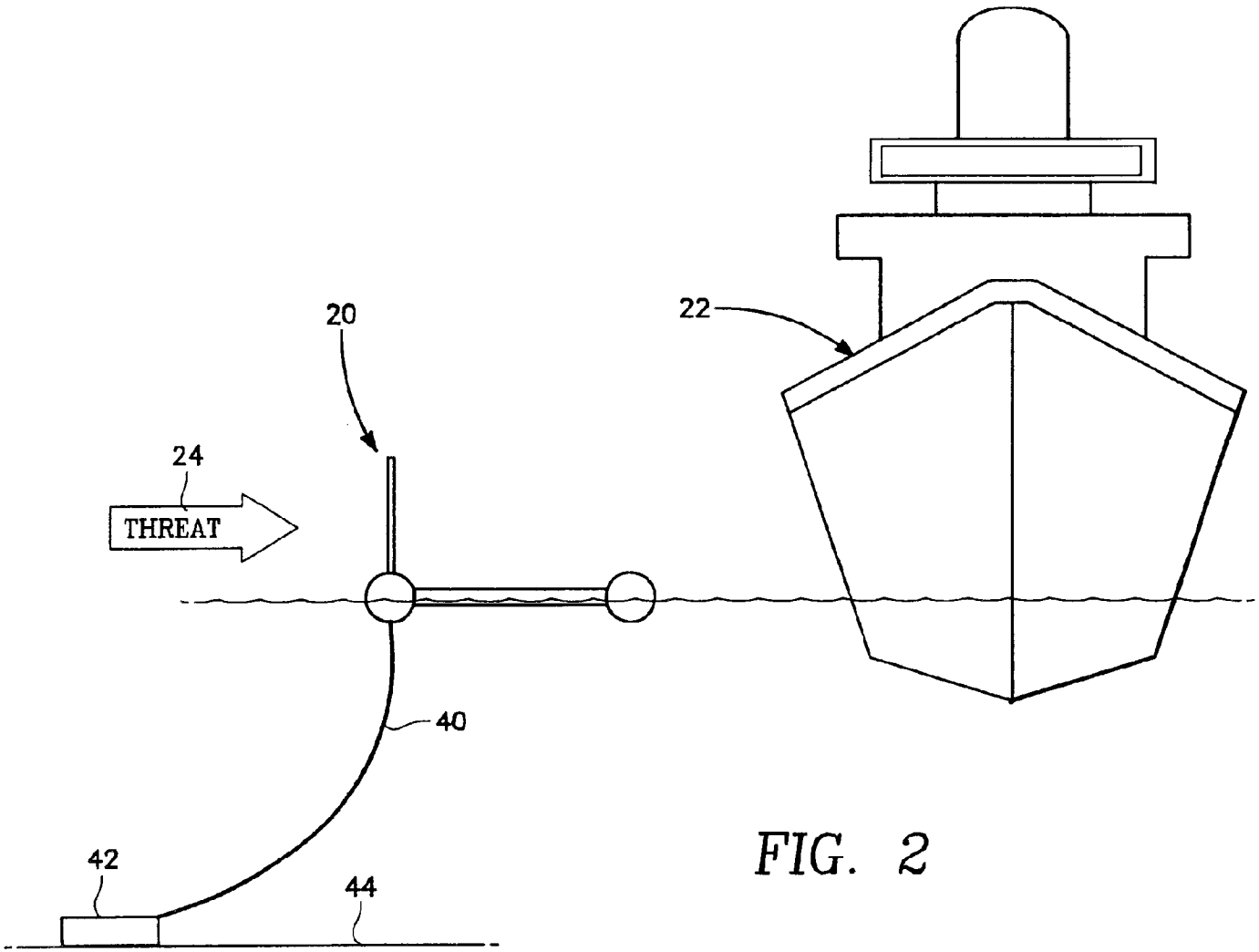
FIG. 2 is a plan view illustrating the modular structure of the near shore port security barrier being used to protect a vessel anchored at sea from attack by a hostile watercraft.

FIG. 2 depicts the protected vessel 22 when the vessel 22 is moored in proximity to the near shore port security barrier 20. Mooring lines 40 connected to barrier 20 and anchors 42 which rest on the ocean floor 44 are used to secure the barrier in a fixed position relative to vessel 22 in the manner illustrated in FIG. 2.

Referring to FIGS. 1–5, barrier fence/screen fence 38 for near shore port security barrier 20 comprises a synthetic or wire mesh fencing material 45 supported by a barrier fence support structure which is attached to and supported by outboard pontoon 34 as well as inboard pontoon 36 and cross members 47 and 48 which when assembled in the manner illustrated in FIG. 3 forms the barrier flotation system 32 for each of the modules 28 of near shore port security barrier 20.

Near shore port security barrier 20 includes a plurality of modules 28 fifty feet in length (FIG. 4) which are designed to be connected to one another in series to provide for a continuous barrier of any desired length. The length of the barrier varies in accordance with the length of vessel 22 to be protected by barrier 20. For example, if the vessel to be protected is an aircraft carrier which is approximately 1100 feet in length, the barrier will consist of at least twenty two modules connected in series in the manner illustrated in FIG. 4. A destroyer, which is about five hundred feet in length, will require approximately ten modules 28 connected in series to protect the destroyer from a threat watercraft.

Figure 5:
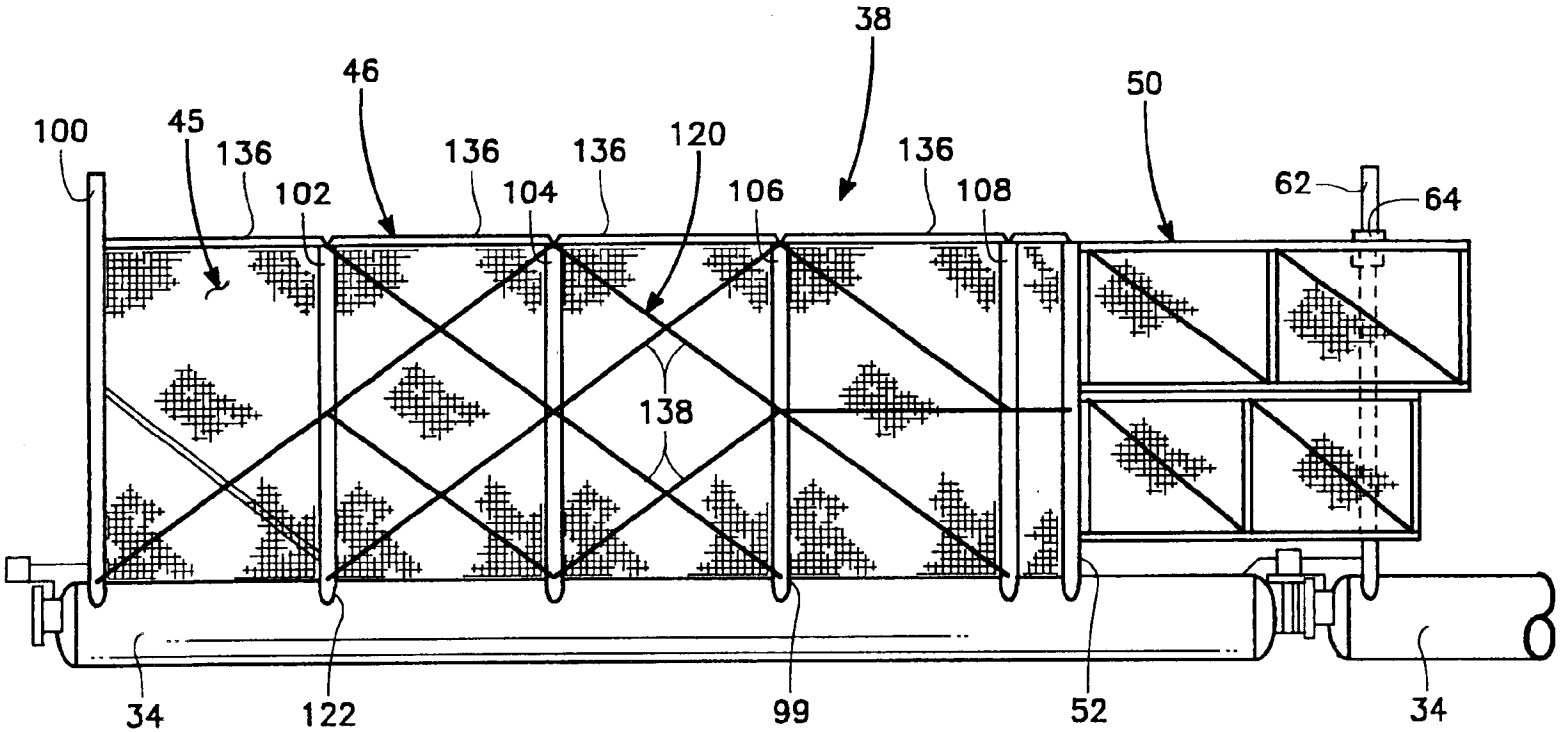
FIG. 5 is a side view illustrating the wire mesh net and the barrier net support structure for the wire mesh net for each barrier module.
Figure 6A:
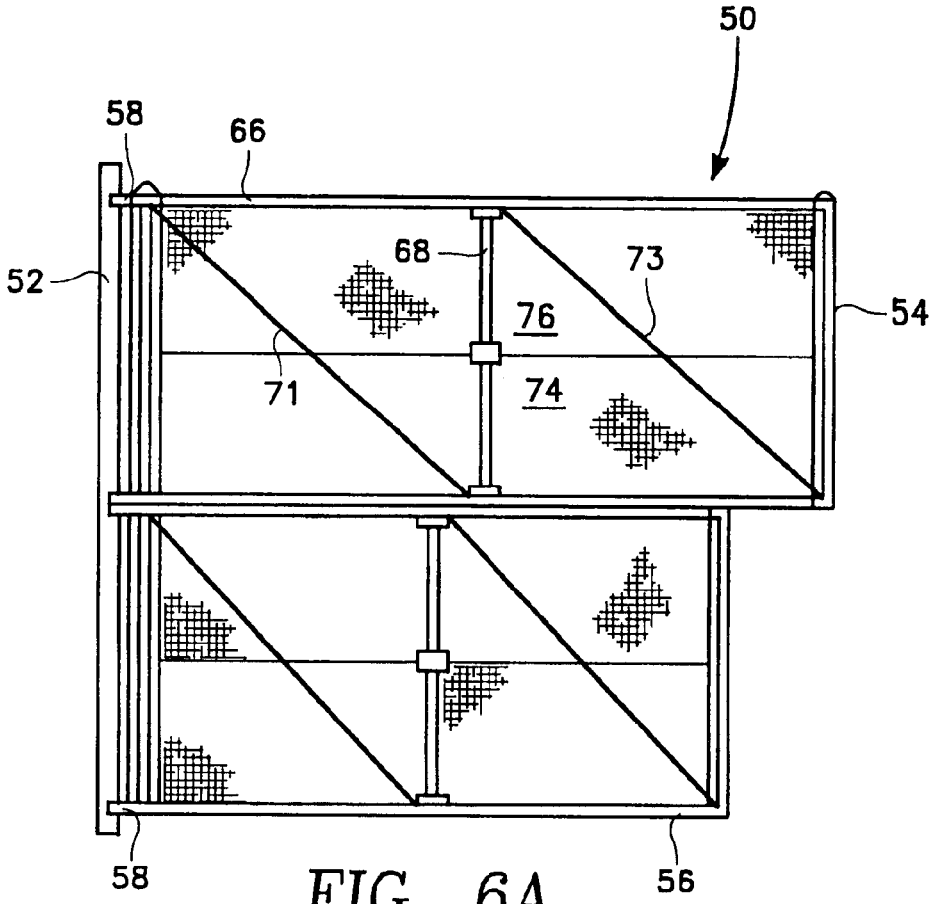
FIGS. 6A and 6B is a detailed side view illustrating the flexible fence for each barrier module which overlaps an adjacent barrier module to insure that the near shore port security barrier is continuous.
Figure 6B:
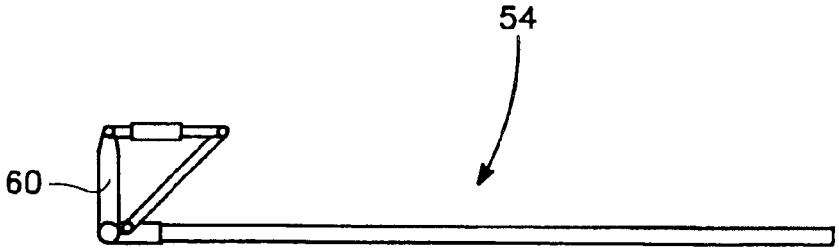

Referring to FIGS. 5, 6A and 6B, the flexible fences 50 on each module 28 overlap with an adjoining module to ensure that near shore port security barrier 20 is continuous along its whole length and the length of vessel 22. Each flexible fence 50 includes a pair of six foot high swing gates 54 and 56 which are hinged at a fence screen support post 52 by a plurality of hinges 58. The upper gate 54 is longer than the lower gate 56 since the upper gate 54 must provide over a wider gap which will occur between adjoining modules 28 of the barrier 20. The upper gate 54 has an overall length of 14 feet 6 inches, while the lower gate 56 has an overall length of 12 feet 6 inches.

At this time it should be noted that the individual modules 28 of near shore port security barrier 20 respond to waves moving relative to each other in roll and pitch and to a lesser extent in yaw. This creates a changing triangular gap between the fixed fences 46 of each module 28. Swing gates 54 and 56 were designed to provide fence coverage for the gap between the fixed fences 46 for each barrier module 28.

With gates 54 and 56 hinged vertically, the gates overlap the fixed fence 46 of the adjoining module 28. Two torsion bar spring assemblies 60, one for each swing gate 54 and 56 hold the swing gate 54 and 56 against the fence screen support post 62 (as indicted by arrow 55) on the adjacent module of near shore port security barrier 20 in the manner illustrated in FIG. 5. Wear pads 64 are installed on post 62 to accommodate the relative lateral motion of adjoining modules 28 under spring loading.

The rectangular shaped tubular support structure 66 for each swing gate 54 and 56 is fabricated from rectangular tubing. The structure 66 is trussed with a centrally located vertical pipe 68 and two diagonal tension bars 71 and 73 to assist each gate in retaining its rectangular shape. A pair of three-foot high screen panels 74 and 76 are attached by bolts to each swing gate 54 and 56.

Referring to FIGS. 1, 2, 3, 4 and 7, near shore port security barrier 20 includes a plurality of identical barrier modules 28 which are buoyant, that is the barrier modules 28 float, and which are interchangeable. The port security barrier also has two end barrier modules 70 (FIG. 7) which have unique fence configurations 72. As shown in FIG. 4, the modules 28 are connected end to end to form a long, segmented catamaran configuration. The modules are connected by a hook and shackle connector assembly 75 between the outboard pontoons 34 of adjacent modules, while a tension-only synthetic line strap 77 is used to connect the inboard pontoons 36 of adjacent modules 28.

Each barrier module 28 is provided with a pair of roller fenders 31 which are components of the rendering system 30 for near shore port security barrier 20. The roller fenders 31 allow the modules to be moored against the side of vessel 22 without damaging the hull of vessel 22.

The outboard pontoon 34 is longer than the inboard pontoon 36 with the outboard pontoon 34 having an overall length of about 50 feet and the inboard pontoon having an overall length of about 38 feet. The cross members 47 and 48 for each module 28 are mounted on the mounted on the pontoons 34 and 36 about four inches clear of the water and secured to the pontoons by bolts to allow for transportation to and assembly of the near shore port security barrier 20 at the port facility. Each cross member 47 an 48 has a pair of lifting eyes 174 for movement of the cross member 47 or 48.

The inboard pontoon 36 for each barrier module 28 comprises a 36-inch diameter, ¼" thick wall a-50 carbon steel pipe/tube 80 with elliptical ends 78 and measures 38 feet in length. Pontoon 36 includes two internal watertight 3⁄16" bulkheads which form three watertight chambers within pontoon 3. The tube 80 has internal stiffeners for cross member stubs which are used to secure the cross members 47 and 48 to pontoon 36. There are also pontoon fenders/ bumpers 82 at each end which are designed to protect the pontoon 36. Pontoon 36 includes 24" wide walkway gratings 83 which allow a user access to each module 28 for repairs.

Referring to FIG. 3, the two rolling fenders 31 for each module 28 are six feet in length and three feet in diameter and fabricated using an internal closed-cell rigid foam and an outer cover for wear resistance. The fenders include a four inch IPS Schedule-80 plastic pipe 84 which allow the fenders to rotate on a U-shaped mounting bracket 86. The rolling fenders 31 are Sea Guard Foam-Filled Marine Fenders commercially available from Seaward of Clearbrook, Va.

Mounting bracket 86 is a U-frame style bent consisting of two legs which offset the fenders 31 from the pontoon 36 and a longitudinal three inch IPS Schedule 80 stainless steel axle 88 which is in rotatable engagement with pipe 84 of fender 31. Axle 88 is designed to transmit moments due to the side load on the fenders reducing the loads applied to the pontoon walls.

Figure 11:
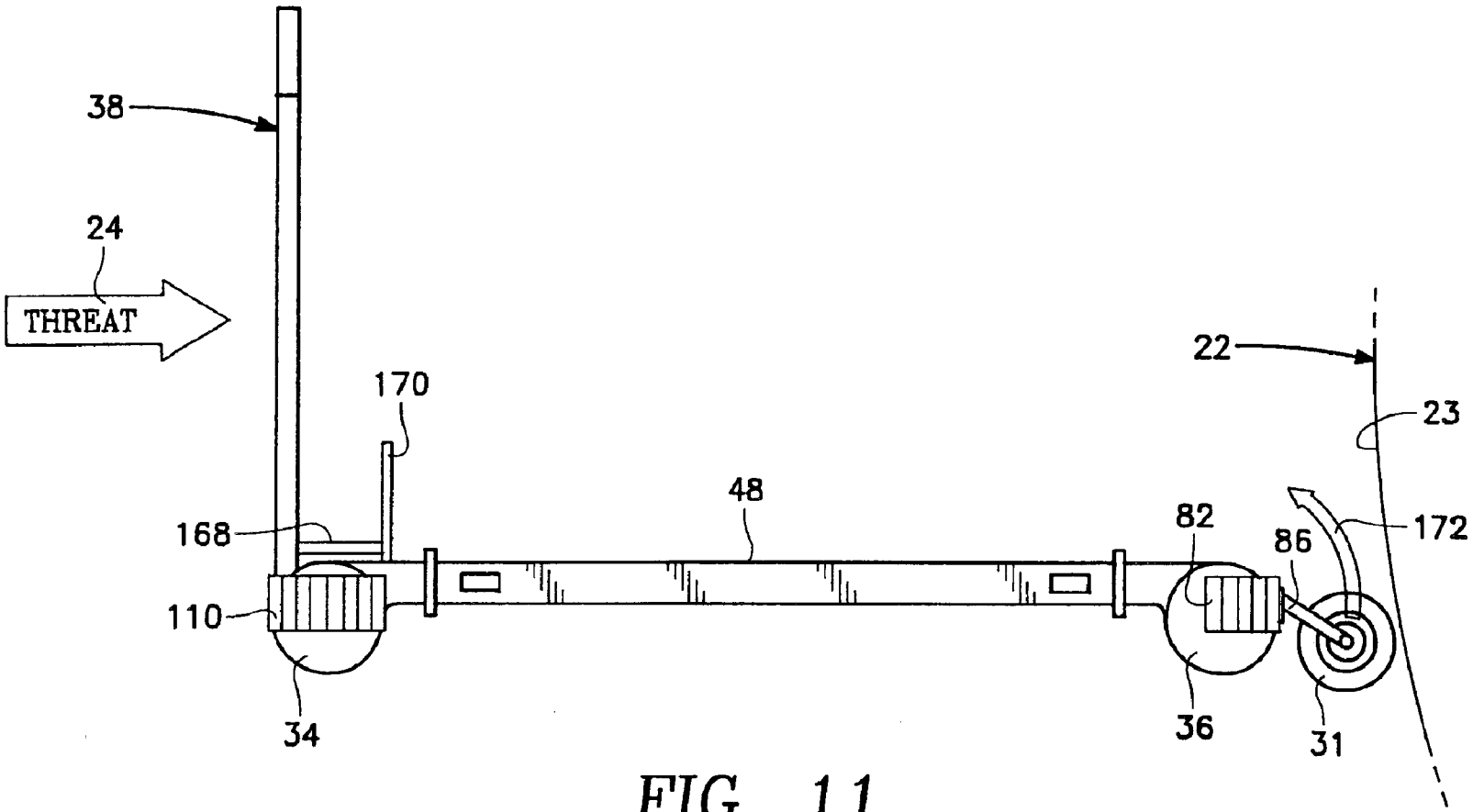
FIG. 11 is a detailed end view of the pontoon fenders at each end of the barrier module which are designed to protect the pontoon.

As shown in FIG. 11, fender 31 can be rotated in the direction of arrow 172 for storage. A crane is used to lift fender 31 upward to a vertical position and fender 31 is then pinned in place.

Each bumper 82 has a foundation support structure for attaching the bumper to the elliptical ends 78 of pontoon 36. A shackle 89 is also attached to each end 78 of pontoon 36 for the tension strap connectors 77 which are used to secure adjacent modules 28 to one another.

Each pontoon 36 also has a pad eye 90 positioned at each end of the pontoon which is used to lift the pontoon for movement from one location to another.

Cross members 47 and 48 comprise 14"×10"×5/16"[1] rectangular tubing caped at each end. The cross members are watertight to provide damage stability and buoyancy. Each cross member 47 and 48 has end post foundations, towing eyes 92 for tow line 94 and a support structure for 24", wide fiberglass walkway grating. As shown in FIG. 3 only cross member 48 includes a walkway grating 96.

Outboard pontoon 34 is almost identical to inboard pontoon 36 except that its length is 48'-6" and it has four internal bulkheads forming five watertight compartments. Outboard pontoon includes fence post foundations for the fence screen support post 100, 102, 104, 106, 108 and 52 (FIG. 5). The fence screen support post 100, 102, 104, 106, and 108 are spaced nine feet apart. Fence screen support post 108 is spaced apart from fence screen support post 52 by about thirty inches.

Outboard pontoon 34 also has a fender 110 at one of its elliptical end 112 and a shackle 114 at its other elliptical end 116. The shackle 114 engages a hook connector 118 on an adjacent pontoon which in conjunction with a line strap 77 secures one module 28 of barrier 20 to an adjacent module of barrier 20. The hook and shackle connector assembly 75 includes hook connector 118 which is a machined high strength steel hook and shackle 114 which is a 55-ton shackle. There is also a fender 117 located at elliptical end 116 of pontoon 34.

Cross member connection stubs are provided to attach Cross members 47 and 48 to outboard pontoon 34. Outboard pontoon 34 also has a 24-inch wide walkway grating 168 to allow user access to the pontoon and for fence repair. There are also cleats 122 positioned at each end of the pontoon which are used to facilitate pontoon movement. Outboard pontoon 34 also has a safety rail 170 which is shown in FIG. 11.

Referring again to FIGS. 1–5, barrier fence/screen fence 38 is a vertical barrier that extends along the outboard side of near shore port security barrier 20 and along the forward and aft side of vessel 22 forming an elongated U shape around the vessel 22. The barrier fence 38 extends vertically upward from the float structure for each module 28 to a height of 14'-6" above the water line. The wire mesh fencing material 45 is installed in a series of panels that are bolted to the fence screen support post 100, 102, 104, 106, 108 and 52. The six foot high swing gates 54 and 56 are installed at the ends of the modules 28 to provide fencing coverage for the gap between modules 28. Wind loads at right angles to the fence 38 are resisted by the strength of the fence post 100, 102, 104, 106, 108 and 52. Off-axis loads are resisted by a truss network of tension and compression braces, designated generally by the reference numeral 120.

The fencing material 45 is installed in a panel fashion. The width of the material to four feet and the panels are installed horizontally. The upper three panels in the fixed fences 46 of each module. 28 are four feet high and a fourth panel is installed at the bottom to the fill the gap between the upper panels and the outboard pontoon 34. This gap is about two feet. The fence material 45 is 316 stainless steel wire mesh which eliminates corrosion maintenance.

The fence post 100, 102, 104, 106, 108 and 52 are W6×12# I-beam sections. The major axis for each fence post 100, 102, 104, 106, 108 and 52 is orientated to withstand lateral wind loads and each fence post includes flanges for bolting the screen panels to the fence post. The fence post 100, 102, 104, 106, 108 and 52 include a taper 122 at their bottom end for drop-in installation and are secured to the pontoon 34 by a single pin which prevents the fence post from jumping out of its foundation. The foundation for each fence post 100, 102, 114, 106, 108 and 52 includes a plate foundation backed up by a partial ring stiffener or watertight bulkhead inside the pontoon 34.

Figure 7:
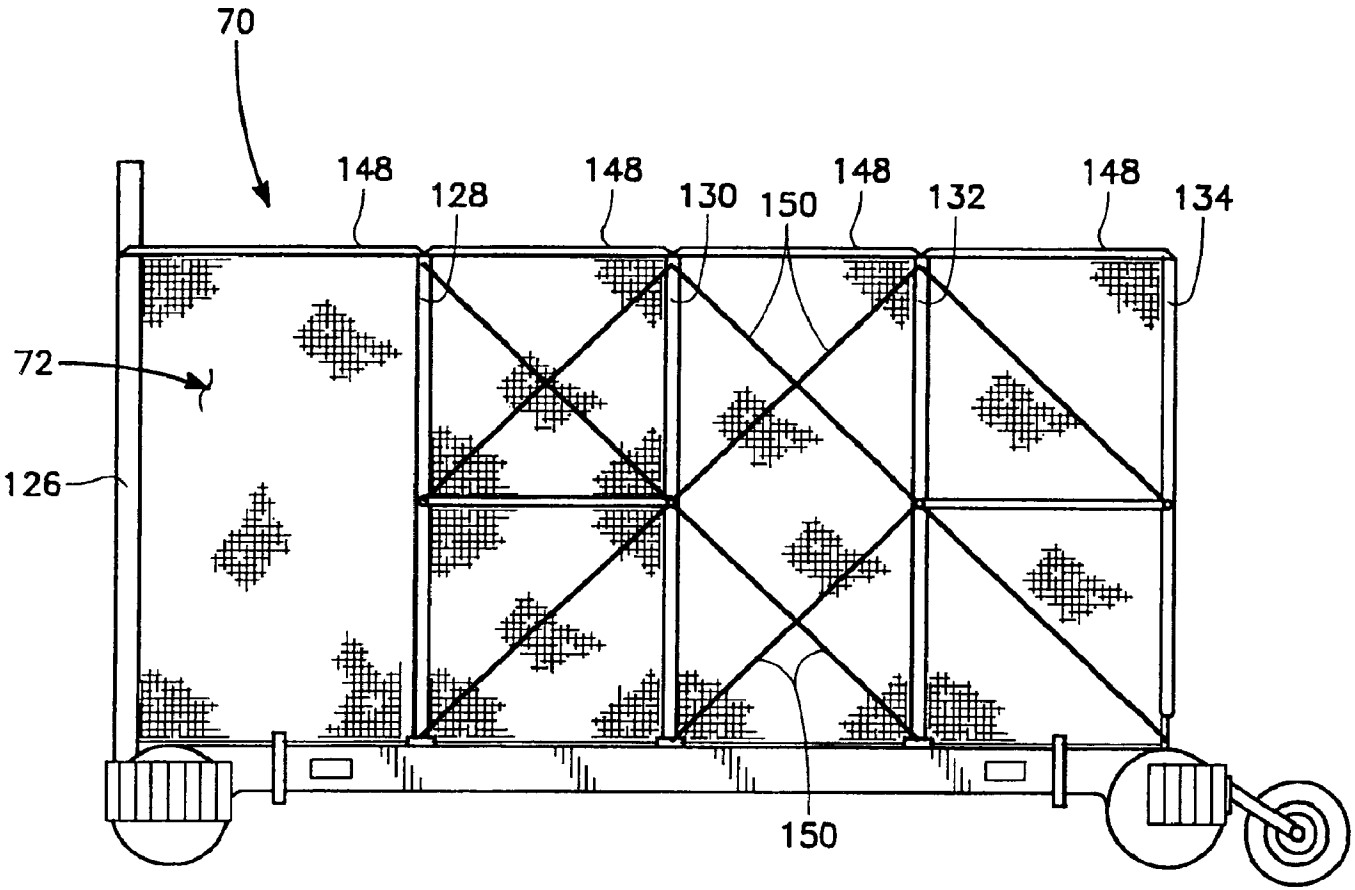
FIG. 7 is a side view illustrating one of the end barrier modules for the near shore port security barrier.

Referring to FIG. 7, the barrier fence 72 on the end barrier modules 70 is supported by fence post 126, 128, 130, 132 and 134. The end barrier modules 70 are 14 feet 6-3/8 inches in height by 27 feet 11 inches in length. FIG. 11 illustrates the end barrier modules without a barrier fence, that the fence structure 72 is optional on the end barrier modules.

Figure 8A:
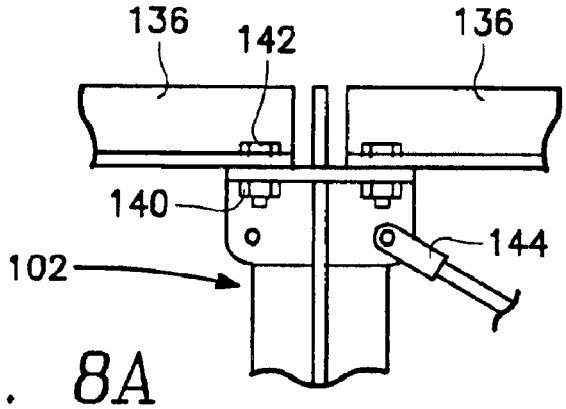
FIGS. 8A–8C illustrate the support bracing for the wire mesh net support structure attached to each fence post of a barrier module.
Figure 8B:
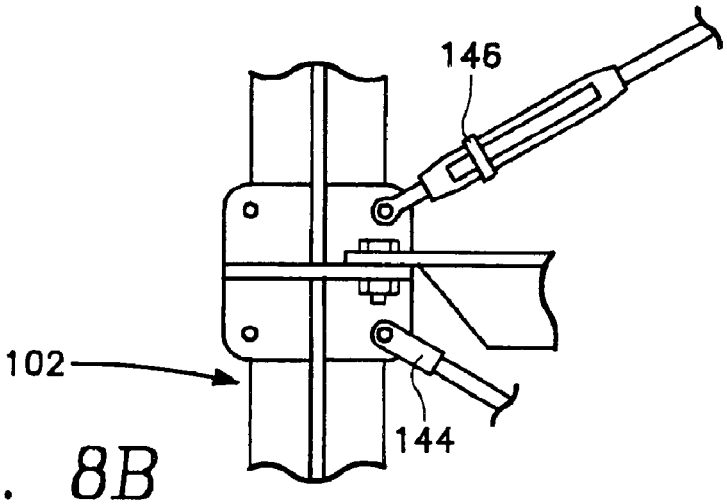

Referring to FIGS. 5 and 8A–8C, since the fence post 100, 104, 106, 108 and 52 for each module 28 are weak laterally and torsionally a system of tension and compression braces is included in the design of the barrier fence 38 to form a statically determinate truss network. The barrier fence 38 for each module 28 includes a plurality of compression braces 136 which are positioned between adjacent fence post at the top of barrier fence 38. As shown in FIG. 8A, the compression braces 136 are connected to fence post 102 using bolts 142 and nuts 140.

At this time it should be noted that compression braces 136 are also connected to fence post 100, 104, 106, 108 and 52 of each module 28 using nuts and bolts in the manner depicted in FIG. 8A.

Figure 8C:
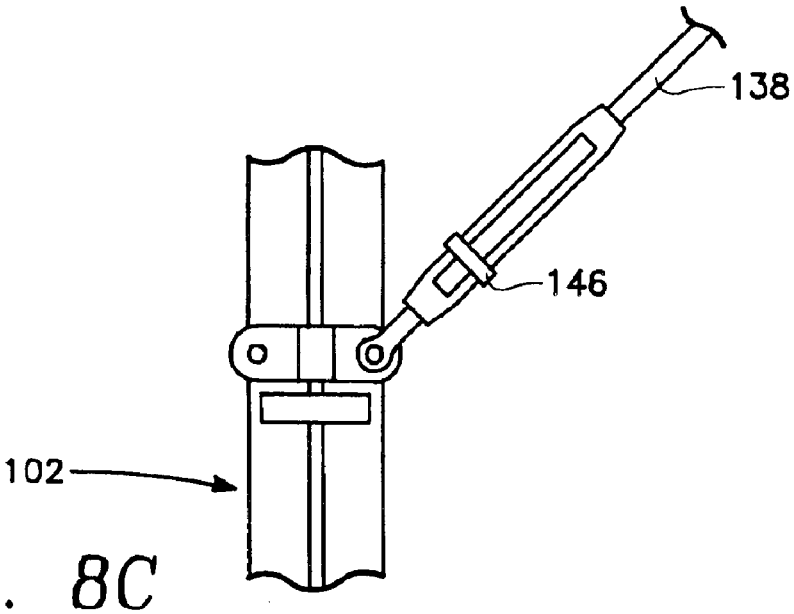
Figure 9:
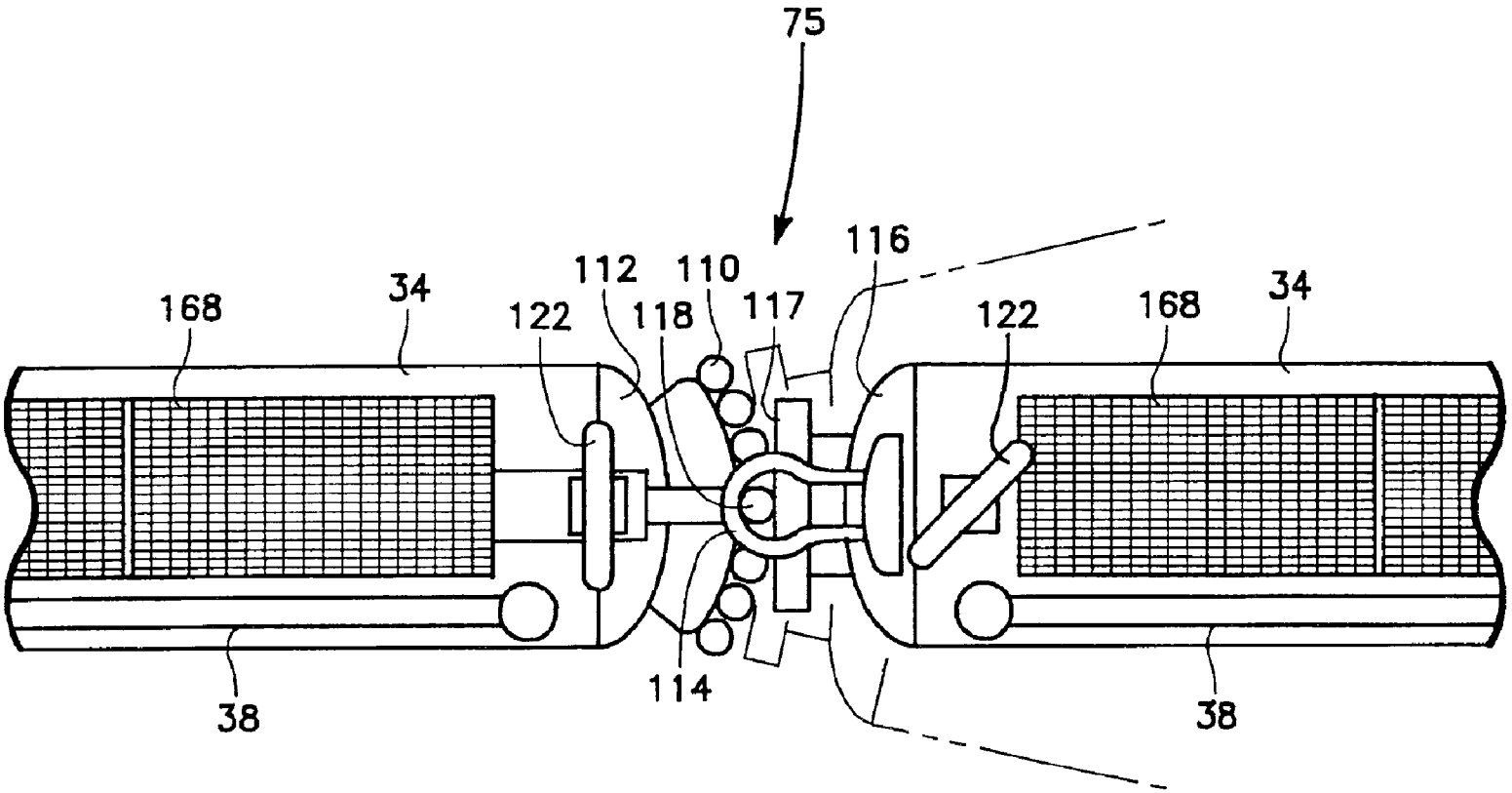
FIG. 9 illustrates the hook mechanism used to connect the outboard pontoons of adjacent barrier modules of the near shore port security barrier.
Figure 10:
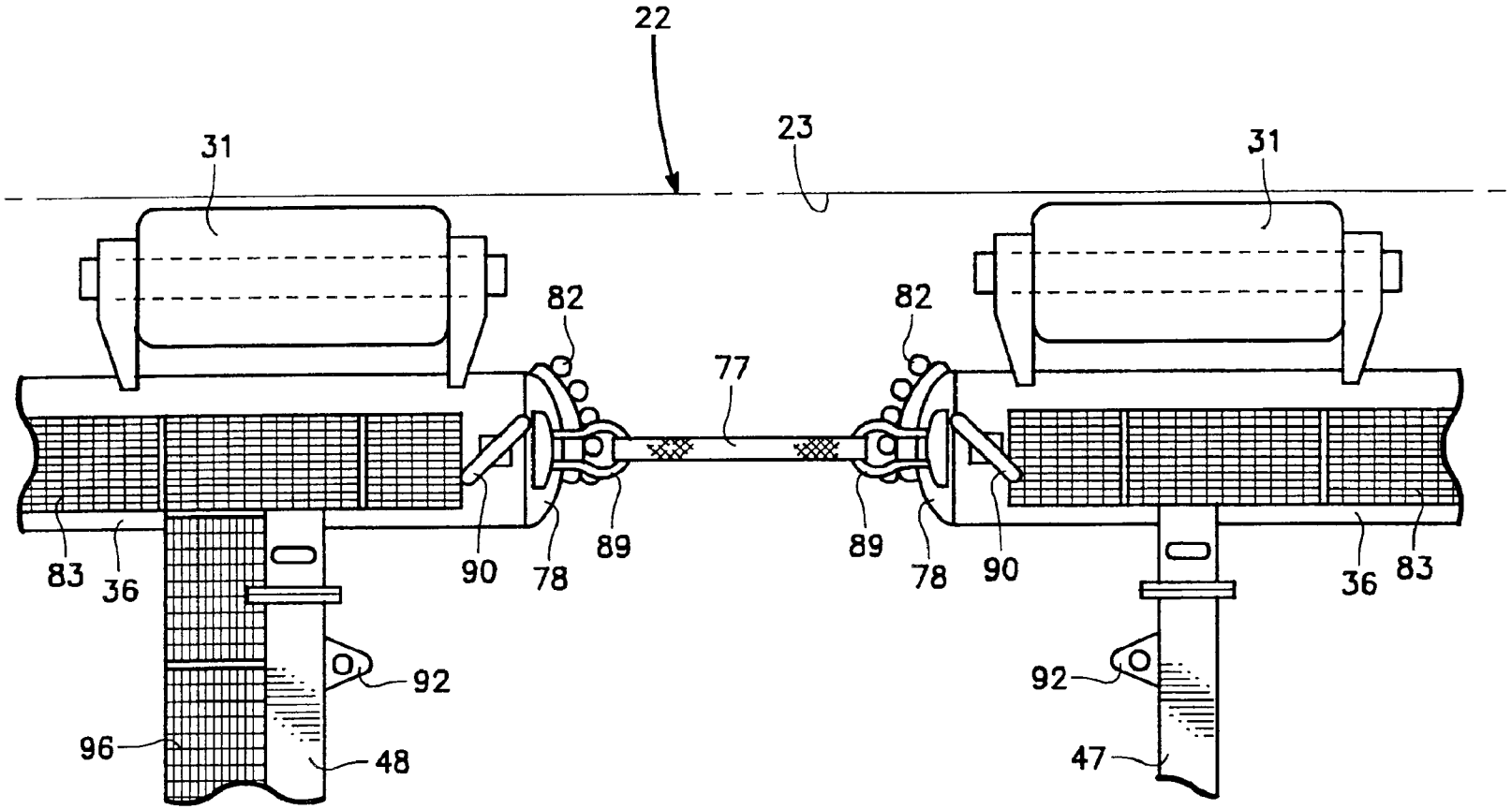
FIG. 10 illustrates a tension-only synthetic line strap which is used to connect the inboard pontoons of adjacent barrier modules of the near shore port security barrier.

The barrier fence 38 for each module 28 also includes a plurality of tension braces 138 which are positioned between adjacent fence post diagonally across the barrier fence 38 in the manner illustrated in FIG. 5. The tension braces 138 for barrier fence 38 are provided with an attachment clevis 144 at the upper end and a turnbuckle 146 at their lower end. The turnbuckle 146 allows a user to adjust the tension on each tension brace. The tension braces are connected to the fence post 100, 104, 106, 108 and 52 of each module 28 at the upper end of each fence post (FIG. 8A), the middle of each fence post (FIG. 8B) and the bottom end of each fence post (FIG. 8C).

Since the fence post 100, 104, 106, 108 and 52 for each module 28 are weak laterally and torsionally a system of tension braces 138 and compression braces 136 is included in the design of the barrier fence 38 to form a statically determinate truss network.

The tension and compression braces are generally ½"diameter rods that provide adequate strength for the barrier fence while substantially reducing weight and wind drag.

Referring to FIG. 7, the two end barrier modules 70 also have a statically determinate truss network. The barrier fence 72 for each module 70 includes a plurality of compression braces 148 which are positioned between adjacent fence post at the top of barrier fence 72. Connection of the compression braces to the fence post is by nuts and bolts in the manner illustrated in FIG. 8A.

The barrier fence 72 for each module 70 also includes a plurality of tension braces 150 which are positioned between adjacent fence post diagonally across the barrier fence 72 in the manner illustrated in FIG. 5. The tension braces 150 for barrier fence 72 are provided with an attachment clevis at the upper end and a turnbuckle at their lower end to connect the tension braces to the fence post.

Figure 12:
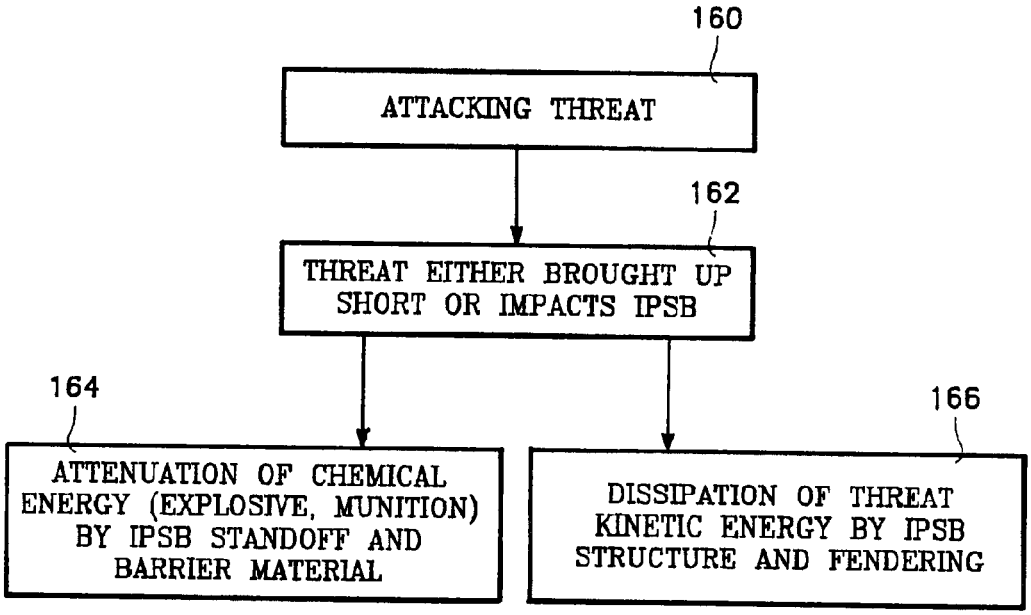
FIG. 12 a block diagram illustrating the operation of the near shore port security barrier.

FIG. 12 illustrates a block diagram of near shore port security barrier 20 in operation. Step 160 depicts a threat watercraft attacking a port facility such as the facility illustrated in FIGS. 1 and 2. Step 162 depicts the threat watercraft either impacting the barrier fence 38 of the near shore port security barrier 20 which stops the craft or bring the craft to a stop short of the near shore port security barrier 20. Step 164 depicts the attenuation by the near shore port security barrier 20 of chemical energy due to an explosion of munitions or other explosive materials aboard the threat craft. Step 166 depicts the dissipation of kinetic energy from the threat watercraft by the barrier fence and support structure for near shore port security barrier 20.

From the foregoing, it may readily be seen that the present invention comprises a new, unique and exceedingly useful port security barrier for protecting vessels dock at a port facility which constitutes a considerable improvement over the known prior art. Many modifications and variations of the present invention are possible in light of the above teachings. It is to be understood that within the scope of the appended claims the invention may be practiced otherwise than as specifically described.

What is claimed is:

1. A near shore port security barrier for protecting a vessel docked at a port facility from an incoming waterborne craft which is being used to inflict damage on said vessel, said near shore port security barrier comprising:

(a) a plurality of floating barrier modules connected to one another to form a floating security barrier which is positioned adjacent a hull for said vessel, said floating barrier being adapted to protect said vessel from said incoming waterborne craft;

(b) a mooring system for said near shore port security barrier, said mooring system having a plurality of mooring lines and a plurality of anchors which rest on the ocean floor, each of said mooring lines having one end connected to said near shore port security barrier and the other end connected to one of said plurality of anchors to secure the near shore port security barrier in a fixed location relative to the vessel;

(c) each of said plurality of floating barrier modules including:

(i) a first pontoon positioned adjacent the hull of said vessel;

(ii) a second pontoon positioned parallel to said first pontoon away from the hull of said vessel;

(iii) first and second spaced apart cross members mounted on an upper end of said first and second pontoons and attached thereto, said first pontoon, said second pontoon and said first and second cross members being configured to form a rectangular shape floating base for each of said floating barrier modules;

(iv) a generally rectangular shaped wire mesh barrier fence extending vertically upward from said second pontoon, said wire mesh barrier fence having a fixed portion and a flexible portion, the flexible portion of said wire mesh fence overlapping the fixed portion of the wire mesh barrier fence for an adjacent floating barrier module of said plurality of floating barrier module; and (v) a wire mesh net support structure extending vertically upward from said second pontoon, said wire mesh net support structure being attached to said second pontoon, said wire mesh net support structure having said wire mesh barrier fence attached thereto; and (d) a fendering system affixed to said plurality of floating barrier modules, said fendering system engaging the hull of said vessel, said fendering system being retractable from the hull of said vessel, said fendering system allowing the floating barrier modules of said near shore port security barrier to be moored against the side of said vessel without damaging the hull of said vessel.

2. The near shore port security barrier of claim 1 wherein the wire mesh barrier fences for said plurality of floating barrier modules form a continuous barrier fence which runs the length of said near shore port security barrier.

3. The near shore port security barrier of claim 1 wherein said wire mesh barrier fence comprises 316 stainless steel wire mesh, said 316 stainless steel wire mesh being for fence material to eliminate corrosion maintenance.

4. The near shore port security barrier of claim 1 wherein the flexible portion of said barrier fence for each of said floating barrier modules comprises a rectangular shaped upper and lower swing gates and a fence support post attached to said second pontoon, said upper and lower swing gates being rotatably mounted on said fence support post to allow rotational movement of said upper and lower swing gates about said fence support post, said upper and lower swing gates including a torsion bar spring assembly which is attached to said fence support post, the torsion bar spring assembly for said upper and lower swing gates insuring that said upper and lower swing gates remains flush with the fixed portion of said adjacent floating barrier module.

5. The near shore port security barrier of claim 1 wherein said fendering system for each of said floating barrier modules comprises:

first and second fenders one of said pair of fenders being positioned at each end of said first pontoon; and first and second U-shaped support brackets attached to said first pontoon, said first and second U-shaped support brackets having a shaft;

the shaft of said first U-shaped support having said first fender rotatably mounted thereon and the shaft of said second support bracket having said second fender rotatably mounted thereon;

said first and second fenders of each of said floating barrier modules engaging the hull of said vessel, said first and second fenders of each of said floating barrier modules being retractable from the hull of said vessel.

6. The near shore port security barrier of claim 1 wherein each of said floating barrier modules has an overall length of approximately fifty feet and an overall width of approximately twenty seven feet eleven inches.

7. The near shore port security barrier of claim 1 wherein the height of said barrier fence is approximately fourteen feet six inches above a water line for said near shore port security barrier system.

8. The near shore port security barrier of claim 1 wherein each cross member of said floating barrier module has a pair of towing eyes attached to a outside surface of said cross member, said pair of towing eyes for each cross member being adapted to receive a tow line to allow said floating barrier module to be moved from a first location to a second location.

9. The near shore port security barrier of claim 1 wherein the wire mesh net support structure for the fixed portion of said wire mesh barrier fence comprises:

a plurality of fence screen support post attached to said second pontoon wherein said plurality of fence screen support post extend vertically upward from said second pontoon, said plurality of fence screen support post being spaced apart approximately nine feet from one another, said plurality of fence screen support post having said wire mesh barrier fence attached thereto;

a plurality of tension braces diagonally positioned between and connected to said fence screen support post which are adjacent to one another; and a plurality of compression braces horizontally positioned between and connected to said fence screen support post which are adjacent to one another wherein said plurality of compression braces are located at the top of said wire mesh barrier fence of each of said floating barrier modules.

10. The near shore port security barrier of claim 1 wherein said first pontoon, said second pontoon and one of said first and second cross members for each of said floating barrier modules has a fiberglass walkway grating mounted on a top side thereof to allow for a user to access said near port security barrier.

11. A near shore port security barrier for protecting a vessel docked at a port facility from an incoming waterborne craft which is being used to inflict damage on said vessel, said near shore port security barrier comprising:

(a) a plurality of floating barrier modules connected to one another to form a floating security barrier which is positioned adjacent a hull for said vessel, said floating barrier being adapted to protect said vessel from said incoming waterborne craft;

(b) a mooring system for said near shore port security barrier, said mooring system having a plurality of mooring lines and a plurality of anchors which rest on the ocean floor, each of said mooring lines having one end connected to said near shore port security barrier and the other end connected to one of said plurality of anchors to secure the near shore port security barrier in a fixed location relative to the vessel;

(c) each of said plurality of floating barrier modules including:

(i) a first pontoon positioned adjacent the hull of said vessel;

(ii) a second pontoon positioned parallel to said first pontoon away from the hull of said vessel;

(iii) first and second spaced apart cross members mounted on an upper end of said first and second pontoons and attached thereto, said first pontoon, said second pontoon and said first and second cross members being configured to form a rectangular shape floating base for each of said floating barrier modules;

(iv) a generally rectangular shaped wire mesh barrier fence extending vertically upward from said second pontoon, said wire mesh barrier fence having a fixed portion and a flexible portion, the flexible portion of said wire mesh barrier fence overlapping the fixed portion of the wire mesh barrier fence for an adjacent floating barrier module of said plurality of floating barrier module; and (v) a wire mesh net support structure extending vertically upward from said second pontoon, said wire mesh net support structure being attached to said second pontoon, said wire mesh net support structure having said wire mesh barrier fence attached thereto;

(d) a fendering system affixed to said plurality of floating barrier modules, said fendering system engaging the hull of said vessel, said fendering system being retractable from the hull of said vessel, said rendering system allowing the floating barrier modules of said near shore port security barrier to be moored against the side of said vessel without damaging the hull of said vessel;

(e) a first floating barrier module of said plurality of floating barrier modules having a front end wire mesh barrier fence and support structure which extends vertically upward from the first cross member for said first floating barrier module; and (f) a second floating barrier module of said plurality of floating barrier modules having a rear end wire mesh barrier fence and support structure which extends vertically upward from the second cross member for said second floating barrier module wherein said front end wire mesh barrier fence and support structure is positioned in proximity to the bow of said vessel and said rear end wire mesh barrier fence and support structure is positioned in proximity to the stern of said vessel.

12. The near shore port security barrier of claim 11 wherein the wire mesh barrier fences for said plurality of floating barrier modules form a continuous barrier fence which runs the length of said near shore port security barrier.

13. The near shore port security barrier of claim 11 wherein said wire mesh barrier fence comprises 316 stainless steel wire mesh, said 316 stainless steel wire mesh being for fence material to eliminate corrosion maintenance.

14. The near shore port security barrier of claim 11 wherein the flexible portion of said barrier fence for each of said floating barrier modules comprises a rectangular shaped upper and lower swing gates and a fence support post attached to said second pontoon, said upper and lower swing gates being rotatably mounted on said fence support post to allow rotational movement of said upper and lower swing gates about said fence support post, said upper and lower swing gates including a torsion bar spring assembly which is attached to said fence support post, the torsion bar spring assembly for said upper and lower swing gates insuring that said upper and lower swing gates remains flush with the fixed portion of said adjacent floating barrier module.

15. The near shore port security barrier of claim 11 wherein said tendering system for each of said floating barrier modules comprises:

first and second fenders one of said pair of fenders being positioned at each end of said first pontoon; and first and second U-shaped support brackets attached to said first pontoon, said first and second U-shaped support brackets having a shaft;

the shaft of said first U-shaped support having said first fender rotatably mounted thereon and the shaft of said second support bracket having said second fender rotatably mounted thereon;

said first and second fenders of each of said floating barrier modules engaging the hull of said vessel, said first and second fenders of each of said floating barrier modules being retractable from the hull of said vessel.

16. The near shore port security barrier of claim 11 wherein each of said floating barrier modules has an overall length of approximately fifty feet and an overall width of approximately twenty seven feet eleven inches.

17. The near shore port security barrier of claim 11 wherein the height of said barrier fence is approximately fourteen feet six inches above a water line for said near shore port security barrier system.

18. The near shore port security barrier of claim 11 wherein each cross member of said floating barrier module has a pair of towing eyes attached to a outside surface of said cross member, said pair of towing eyes for each cross member being adapted to receive a tow line to allow said floating barrier module to be moved from a first location to a second location.

19. The near shore port security barrier of claim 11 wherein the wire mesh net support structure for the fixed portion of said wire mesh barrier fence comprises:

a plurality of fence screen support post attached to said second pontoon wherein said plurality of fence screen support post extend vertically upward from said second pontoon, said plurality of fence screen support post being spaced apart approximately nine feet from one another, said plurality of fence screen support post having said wire mesh barrier fence attached thereto;

a plurality of tension braces diagonally positioned between and connected to said fence screen support post which are adjacent to one another; and a plurality of compression braces horizontally positioned between and connected to said fence screen support post which are adjacent to one another wherein said plurality of compression braces are located at the top of said wire mesh barrier fence of each of said floating barrier modules.

20. The near shore port security barrier of claim 11 wherein said first pontoon, said second pontoon and one of said first and second cross members for each of said floating barrier modules has a fiberglass walkway grating mounted on a top side thereof to allow for a user to access said near port security barrier.

* * * * *